US009372029B2

(12) United States Patent
Seo et al.

(10) Patent No.: US 9,372,029 B2
(45) Date of Patent: Jun. 21, 2016

(54) LOW TEMPERATURE STORAGE APPARATUS AND A METHOD OF OPERATING THE SAME

(71) Applicant: LG ELECTRONICS INC., Seoul (KR)

(72) Inventors: Woonkyu Seo, Seoul (KR); Hyein Yang, Seoul (KR); Sungdu Kwon, Seoul (KR); Samnyol Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 173 days.

(21) Appl. No.: 14/192,064

(22) Filed: Feb. 27, 2014

(65) Prior Publication Data

US 2014/0313693 A1 Oct. 23, 2014

(30) Foreign Application Priority Data

Apr. 18, 2013 (KR) ..... 10-2013-0042962

(51) Int. Cl.
*F25D 27/00* (2006.01)

(52) U.S. Cl.
CPC ..... *F25D 27/005* (2013.01); *F25D 2331/807* (2013.01); *F25D 2400/361* (2013.01); *F25D 2500/06* (2013.01); *F25D 2700/02* (2013.01); *F25D 2700/06* (2013.01)

(58) Field of Classification Search
CPC . F25D 29/00; F25D 27/005; F25D 2331/807; F25D 2700/06; F25D 2500/06
USPC ..... 62/127
See application file for complete search history.

(56) References Cited

U.S. PATENT DOCUMENTS

2002/0178066 A1 11/2002 Roh et al.
2008/0250797 A1* 10/2008 Rozendaal ..... F25D 29/00 62/127
2012/0260683 A1* 10/2012 Cheon ..... F25D 29/00 62/125

FOREIGN PATENT DOCUMENTS

CN 1388348 A 1/2003
CN 102770728 A 11/2012
DE 10 2010 043 241 5/2012
EP 2 525 171 11/2012

(Continued)

OTHER PUBLICATIONS

European Search Report dated Mar. 25, 2015.

(Continued)

*Primary Examiner* — Karabi Guharay
(74) *Attorney, Agent, or Firm* — Ked & Associates, LLP

(57) ABSTRACT

A low temperature storage apparatus may include a main body, a door opening and closing a storage chamber formed in the main body, a tray including storage slots receiving items to be stored, a light emitting device, a light sensing device including light receiving sensors sensing light incident on the storage slots from the light emitting device, and a controller controlling the light emitting device, receiving sensing signals, and providing status information related to the items received in the storage slots. The controller may switch the light emitting device on when the door is opened, and may sense whether or not a sensing signal is changed when the door is closed. The controller may count time from a point of change of the sensing signal if the sensing signal is changed from a signal indicating absence of a storage item to presence of a storage item, and may switch the light emitting device off when a predetermined time from closing of the door has elapsed.

20 Claims, 15 Drawing Sheets

(56) References Cited

FOREIGN PATENT DOCUMENTS

| | | | | |
|---|---|---|---|---|
| JP | 2010-255877 | | | 11/2010 |
| JP | 2010255877 | A | * | 11/2010 |
| KR | 10-2010-0064613 | | | 6/2010 |
| WO | WO 2006/062491 | | | 6/2006 |
| WO | WO 2011/111382 | A | | 9/2011 |

OTHER PUBLICATIONS

Chinese Office Action issued in Application No. 201410105410,2 dated Nov. 18, 2015.

* cited by examiner

LOW TEMPERATURE STORAGE APPARATUS AND A METHOD OF OPERATING THE SAME

CROSS-REFERENCE TO RELATED APPLICATION(S)

This application claims priority under 35 U.S.C. §119 to Korean Application No. 10-2013-0042962 filed in Korea on Apr. 18, 2013, whose entire disclosure is hereby incorporated by reference.

BACKGROUND

1. Field

This relates to a low temperature storage apparatus, and more particularly, to a low temperature storage apparatus which may provide state information stored therein.

2. Background

A refrigerator may store items in a frozen state or in a refrigerated state using cool air generated by a refrigerating cycle including of a compressor, a condenser, an expansion valve, and an evaporator. Such a refrigerator may include a freezing chamber storing items in a frozen state and a refrigerating chamber storing items at a low temperature. Refrigerators may be divided into a top mount-type refrigerator in which a freezing chamber is disposed above a refrigerating chamber, a bottom freezer-type refrigerator in which a freezing chamber is disposed below a refrigerating chamber, and a side by side-type refrigerator in which a freezing chamber and a refrigerating chamber are disposed side by side. Items which need to be stored at a temperature of 0~5° C., i.e., a refrigerated state, may include, for example, vegetables, fruits, eggs, beverages and various other items, and may be received in the refrigerating chamber.

In order to check, for example, a quantity and/or an expiration date, a user opens the door of the refrigerator and makes a visual confirmation. Similarly, in a low temperature storage apparatus which stores articles having a specific shape, such as beverage vending machine, a service person must frequently open a door of the machine and confirm the number of stored articles to ensure an adequate supply are available for purchase.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. A low temperature storage apparatus in accordance with one embodiment as broadly described herein may be applied to a refrigerator storing items in a frozen or refrigerated state, or a storage apparatus storing items having a predetermined shape, such as a can receiving apparatus or an automatic vending machine.

Figure 1:
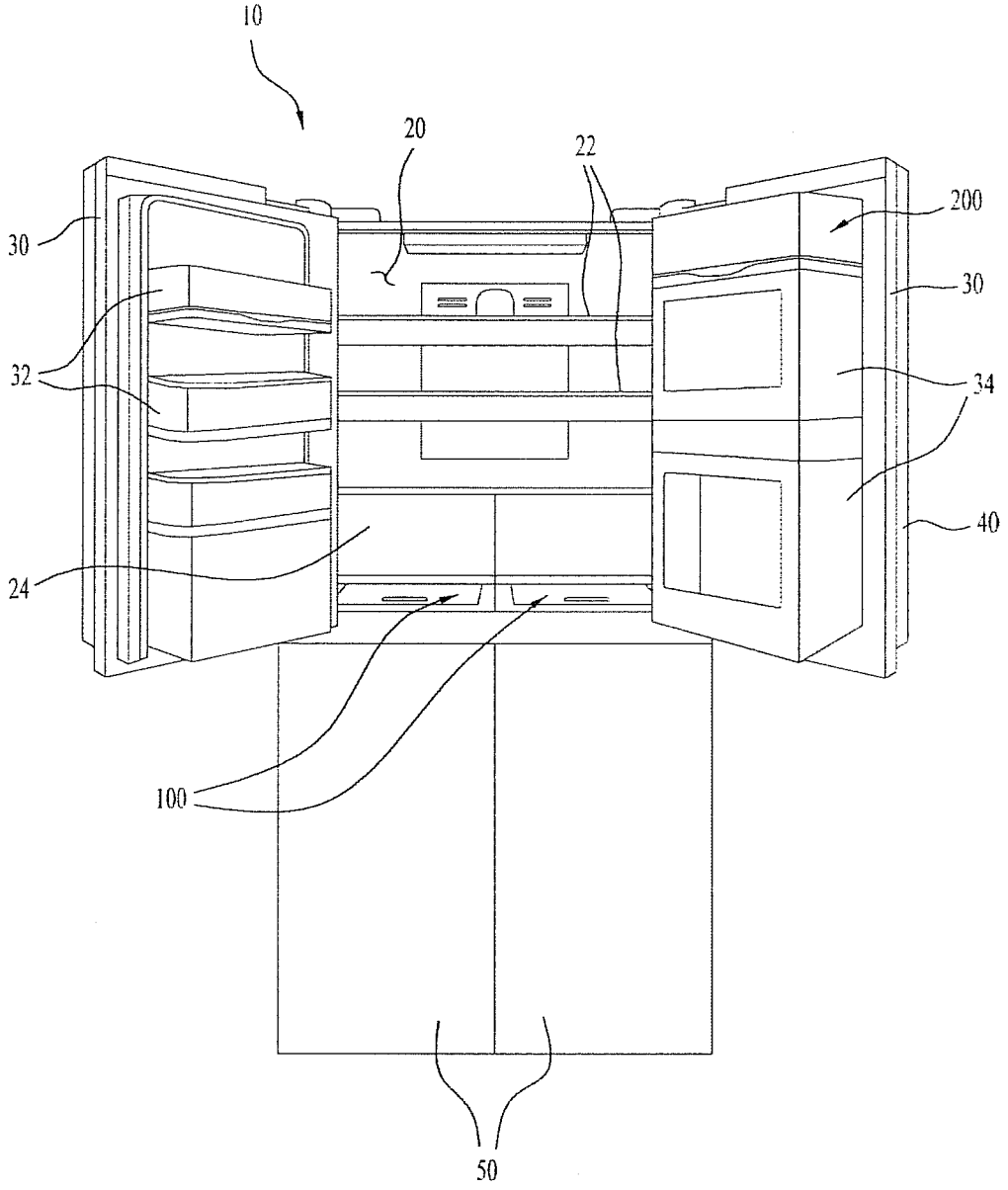
FIG. 1 is a front view of a refrigerator in accordance with one embodiment as broadly described herein.

First, an exemplary refrigerator having egg trays receiving eggs, to which the low temperature storage apparatus as embodied and broadly described herein is applied, will be described below. The exemplary refrigerator shown in FIG. 1 is a bottom freezer-type refrigerator in which a refrigerating chamber 20 is disposed in the upper portion of a main body 10 and a freezing chamber is disposed in the lower portion of the main body 10. However, the disclosure is not limited to such a refrigerator, and other refrigerator/freezing chamber arrangements may also apply.

A pair of main doors 30 may be rotatably mounted at two opposite sides of the upper portion of the main body 10 to open and close the refrigerating chamber 20, and a pair of sub-doors 40 may be rotatably mounted on the pair of main doors 30. A pair of doors 50 may be rotatably mounted at two opposite sides of the lower portion of the main body 10 to open and close the freezing chamber. However, a drawer-type door may be provided as the freezing chamber door.

A plurality of shelves 22 may be mounted in the refrigerating chamber 20, particularly in the upper portion of the inside of the refrigerating chamber 20. The shelves 22 may be mounted on and supported by cantilever-type shelf guides, or be supported by a plurality of shelf supports protruding from the left and right walls of the refrigerating chamber 20. Drawers 24 may be mounted in the lower portion of the refrigerating chamber 20 so as to be slidably withdrawn, and a shelf may be mounted on the drawers 24 so that stored articles may be accommodated on the shelf. A plurality of door shelves or racks 32 and/or a plurality of storage cases 34 may be mounted on the inner surfaces of the main doors 30. One or more first egg storage devices 100 may be provided on the bottom of the refrigerating chamber 20, and a second egg storage device 200 may be provided on the inner surface one of the refrigerating chamber doors.

Figure 2:
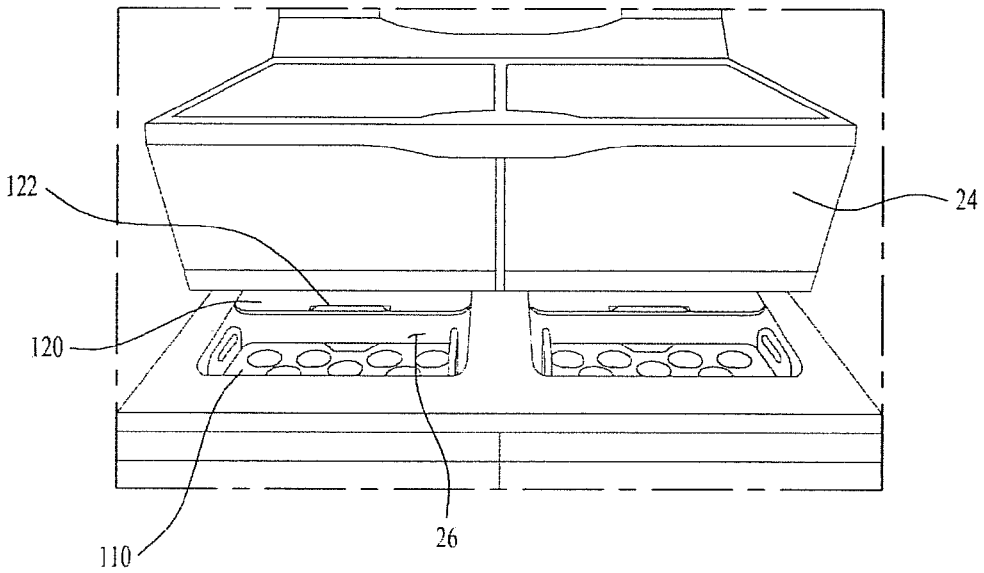
FIG. 2 is a partial view of egg trays received in recesses provided in a bottom of a refrigerating chamber of the refrigerator shown in FIG. 1.

First, with reference to FIGS. 2 to 6B, the structure of the first egg storage device 100 will be described in detail. In this particular exemplary embodiment, a pair of first egg devices 100 is disposed side by side. As shown in FIG. 2, openings, or recesses, 26 receiving egg trays 110 may be formed on the bottom of the refrigerating chamber 20. The recesses 26 formed at both sides of the bottom of the refrigerating chamber 20 to form a pair, and the egg trays 110 may be respectively received in the pair of recesses 26.

Covers 120 may be provided at open upper ends of the recess 26 and may thus open and close the recesses 26. The drawers 24 may be slightly separated from the bottom of the refrigerating chamber 20, and the covers 120 may be slidable through gaps formed between the lower surfaces of the drawers 24 and the bottom of the refrigerating chamber 20. Handles 122 may be provided at upper front surfaces of the covers 120 so that a user may easily open and close the covers 120 using the handles 122. The covers 120 may be formed of a transparent material so that the interiors of the recesses 26 may be visible without opening the covers 120.

Figure 3:
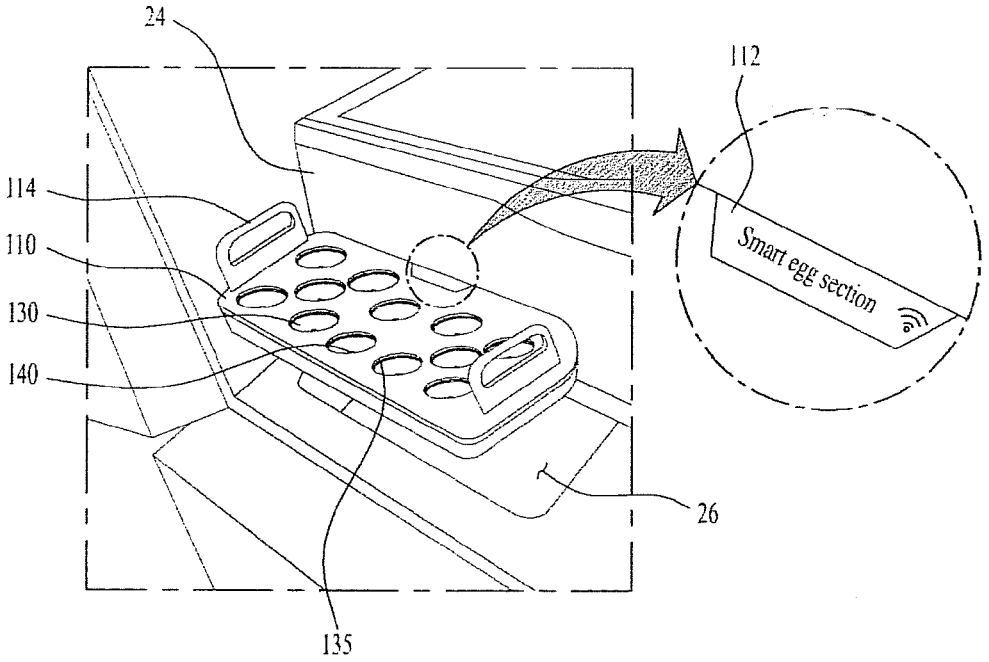
FIG. 3 is a partial perspective view of lifted state of the egg tray shown in FIG. 2.

As shown in FIG. 3, the egg tray 110 may include a plurality of storage slots 130 formed in a somewhat semi-spherical shape so as to receive and support an egg therein, and a plurality of through holes 140 respectively formed at the centers of the storage slots 130. The storage slot 130 may be formed in a hemispheric concave shape so as to receive an egg. The through hole 140 may be formed through the bottom of each of the plural storage slots 130 and thus, if an egg is not received in the storage slot 130, light may enter the storage slot 130 via the through hole 140.

The egg tray 110 may have handles 114 formed at two opposite ends thereof and thus, a user may easily lift or move the egg tray 110 while grasping the handles 114. The egg tray 110 may be detachably mounted in the recess 26. With eggs loaded into the egg tray 110, the user may open the cover 122 and lift the egg tray 110 up and out of the recess 26 while grasping the handles 114. When the user puts eggs into the egg tray 110, inserts the egg tray 110 into the recess 26, and then closes the cover 122, the eggs may be easily accommodated in the egg tray 110.

The egg tray 110 may further include rubber rings 135 mounted at the upper ends of the plural storage slots 130 and elastically supporting received eggs. The rubber rings 135 may be inserted into stepped parts formed at the upper ends of the respective storage slots 130, thus being supported in the storage slots 130. The rubber ring 135 may smoothly support a received egg so as not to be broken. Further, the rubber ring 135 may prevent light from leaking through the hole 140 when the egg is received in the storage slot 130 and may thus prevent generation of a sensing error from an illumination sensor.

A display part 112 displaying, for example, such as, characters, for example, "smart egg section", together with marks may be provided at one side of the upper surface of the egg tray 110 so that a user may easily recognize an egg storage area. The display part 112 may include LED lighting so as to be highly visible by a user.

A light emitting device 21 (see FIG. 11) may be installed in the refrigerating chamber 20 to cause the inside of the refrigerating chamber 20 to be highly visible when the door is opened. Such a light emitting device 21 may be operated by, for example, a door switch 31 sensing whether or not the door is opened or closed. That is, when the refrigerating chamber door 30 is opened, the door switch 31 senses opening of the refrigerating chamber door 30 and, the light emitting device 21 is switched on. Further, when the refrigerating chamber door 30 is closed, the door switch 31 senses closing of the refrigerating chamber door 30 and, the light emitting device 21 is switched off. However, in this embodiment, the light emitting device 21 may maintain the switched-on state for a predetermined time after the door is closed and thus, a light sensing device may sense the presence and absence of stored articles.

Figure 4:
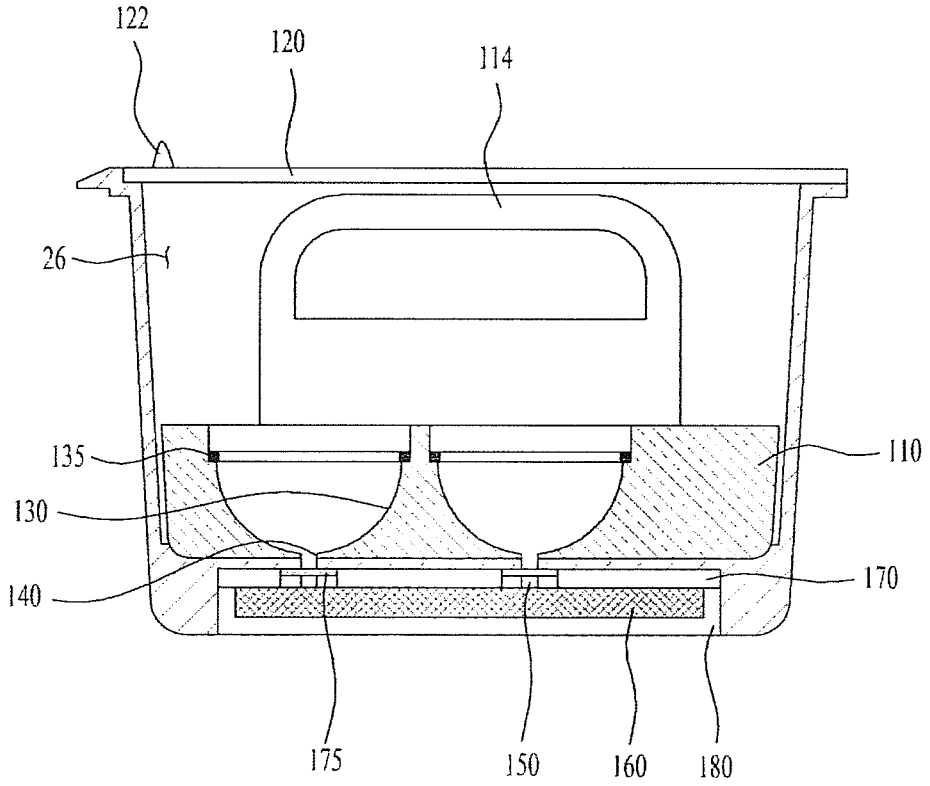
FIG. 4 is a cross-sectional view of the egg tray and the recess shown in FIG. 2.

As shown in FIG. 4, a light sensing device including a plurality of light receiving sensors 150 may be disposed below the plurality of storage slots 130 and may sense light incident upon the storage slots 130/through the through holes 140. The plurality of light receiving sensors 150 may be a plurality of illumination sensors respectively disposed under the plurality of through holes 140.

The plurality of illumination sensors 150 may transmit several pieces of sensing signal data and may thus be disposed on a circuit board 160. If the illumination sensors 150 and/or the circuit board 160 get damp or are exposed to broken eggs or foreign substances via the through holes 140, the illumination sensors 150 and the circuit board 160 may malfunction. Therefore, the illumination sensors 150 and the circuit board 160 may be surrounded by and closed within a case.

Figure 5:
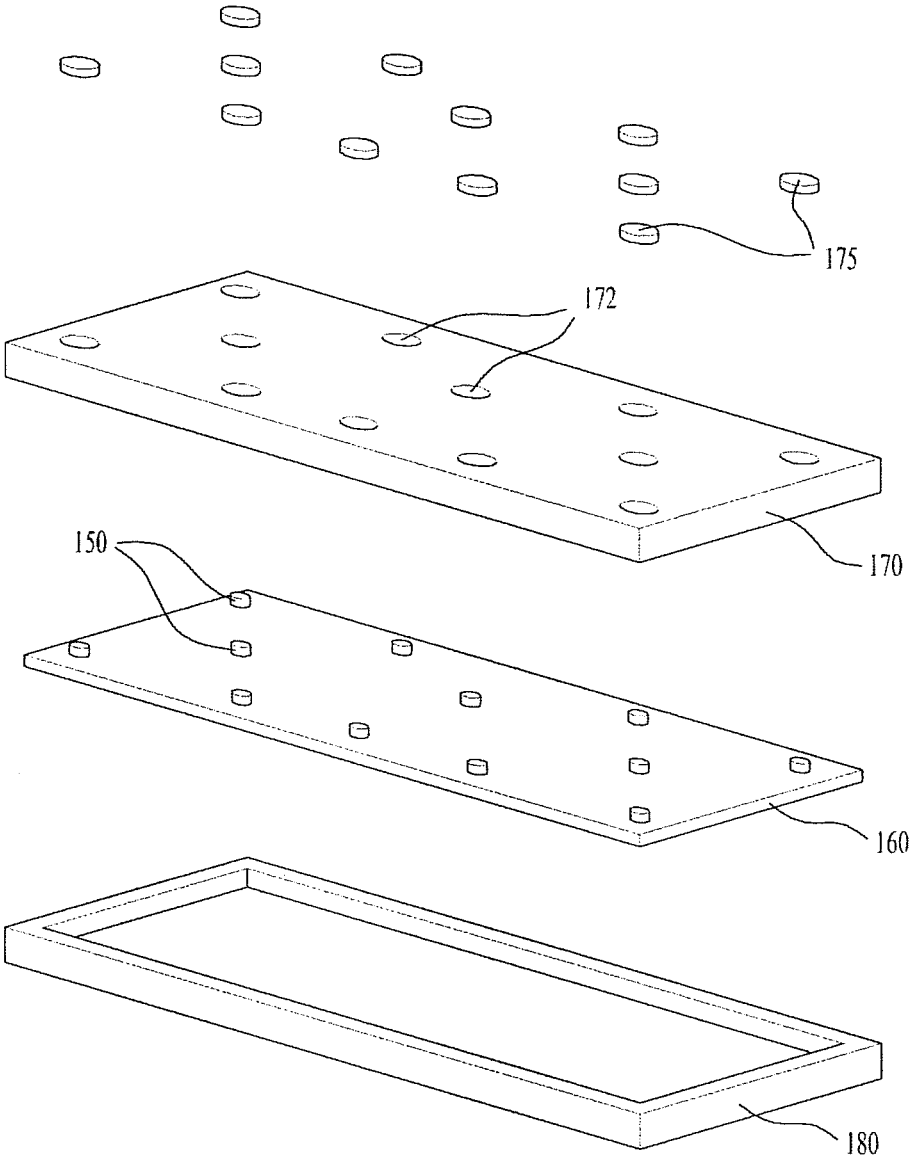
FIG. 5 is an exploded perspective view of a light sensing device installed on the bottom of the recess.

As shown in FIGS. 4 and 5, the light sensing device may include the circuit board 160 including the plurality of illumination sensors 150 provided at positions corresponding to the plurality of through holes 140, a cover plate 170 covering the upper surface of the circuit board 160 and including a plurality of accommodation holes 172, into which the plurality of illumination sensors 150 is inserted, and a base plate 180 attached to the lower surface of the circuit board 160.

In certain embodiments the cover plate 170 may form the bottom surfaces of the recesses 26, or, alternatively, the cover plate 170 may be positioned under the bottom of a case forming the recesses 26. In this case, a plurality of holes may be formed in the bottom of such a case, connected to the plurality of through holes 140.

The plurality of illumination sensors 150 may be connected to an electric circuit of the circuit board 160.

The size of the accommodation holes 172 may be greater than that of the illumination sensors 150 such that dimensional tolerances are allowed.

The accommodation holes 172 may be closed by transparent lids 175 inserted into the accommodation holes 172 from the top. By closing the upper surfaces of the accommodation holes 172 with the transparent lids 175, permeation of moisture or foreign substances into the accommodation holes 172 may be prevented and the illumination sensors 150 may sense light incident upon the accommodation holes 130 through the transparent lids 175.

Figure 6A:
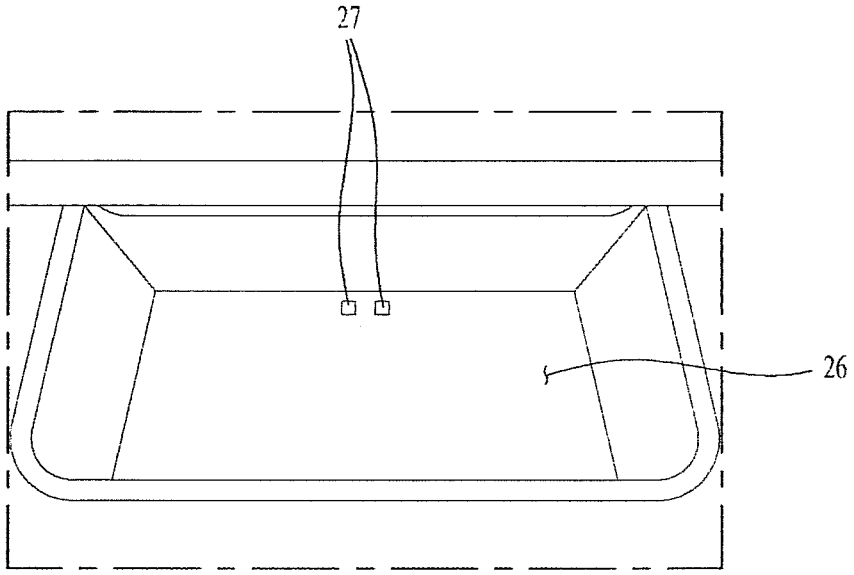
FIGS. 6A and 6B are partial perspective views of respective terminals of the recess and the egg tray.
Figure 6B:
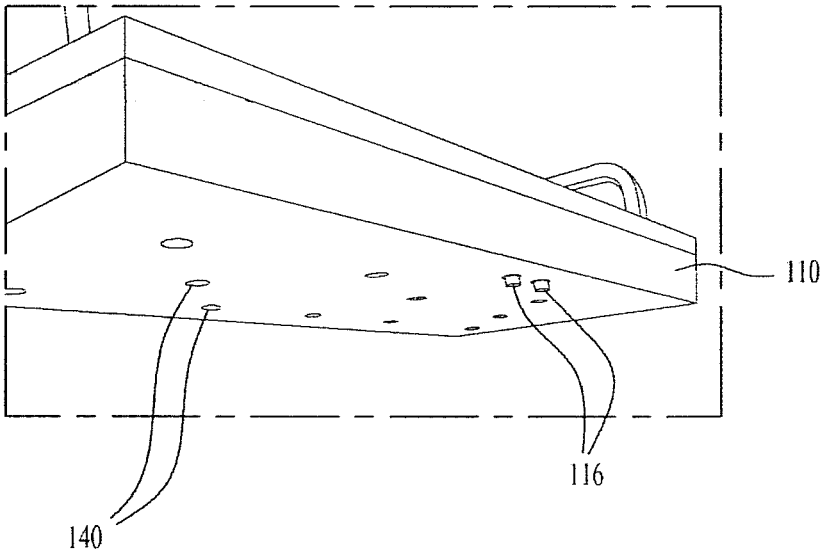

Further, as exemplarily shown in FIGS. 6A and 6B, the egg tray 110 may further include the display part 112 (with reference to FIG. 3) provided at one side of the egg tray 110 and tray terminals 116 connected to the display part 112 and protruding form the lower surface of the egg tray 110, and fixing terminals 27 connected to the tray terminals 116 may be provided at positions of the recess 26 corresponding to the tray terminals 116.

The display part 112 has been described above as displaying, for example a logo. Such a logo may be implemented by LEDs and thus, the display part may be referred to as the lighting part 112.

As shown in FIG. 6B, two tray terminals 116 may elastically protrude from one side of the lower surface of the egg tray 110. As shown in FIG. 6A, two fixing terminals 27 may be formed in a concave shape at positions of the bottom surface of the recess 26 corresponding to the tray terminals 116.

While the plurality of through holes 140 formed on the lower surface of the egg tray 110 are illustrated in FIG. 6B, the plurality of through holes 140 formed on the lower surface of the egg tray 110 are omitted in FIG. 6A.

When the egg tray 110 is received in the recess 26, the tray terminals 116 are in contact with the fixing terminals 27 and thus electrically connected to the fixing terminals 27. Then, the lighting part 112 is turned on and, power is supplied to the illumination sensors 150 located on the bottom of the recess 26 and the illumination sensors 150 sense light introduced via the through holes 140. That is, the illumination sensors 150 are operated when the tray terminals 116 are connected to the fixing terminals 27. Since the illumination sensors 150 generate sensing signals only when the egg tray 110 is received in the receipt hole 26, unnecessary operation of the illumination sensors 150 may be minimized.

Next, the structure of the second egg storage device 200 will be described in detail with reference to FIGS. 7 to 10.

Figure 7:
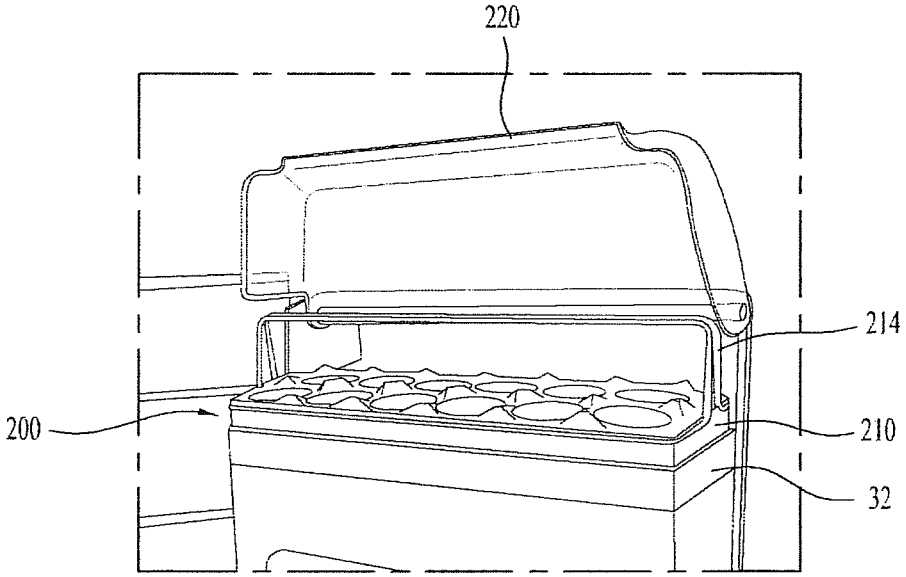
FIG. 7 is a partial perspective view of an egg tray mounted on a door shelf of the refrigerator shown in FIG. 1.
Figure 8:
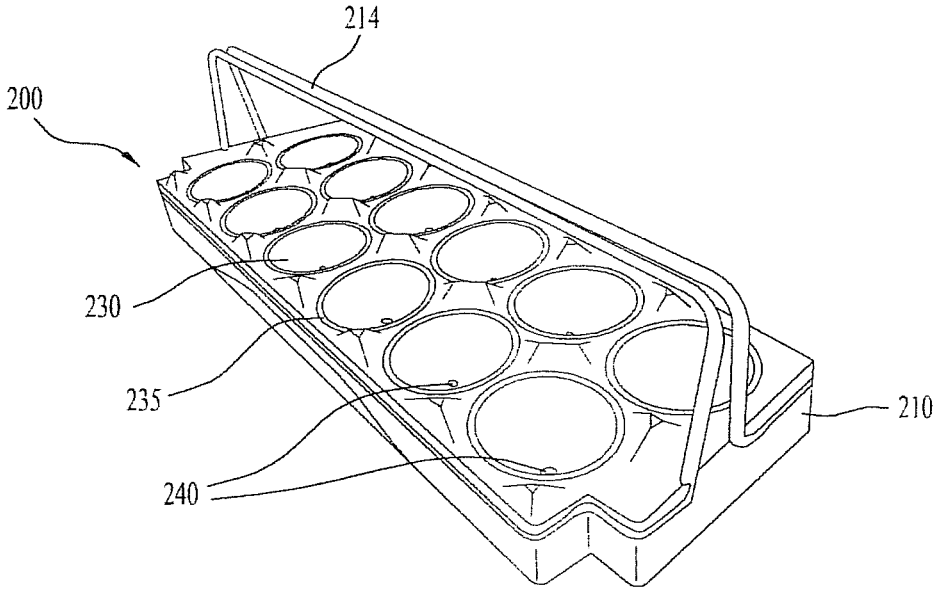
FIG. 8 is a perspective view of the egg tray shown in FIG. 7.
Figure 9:
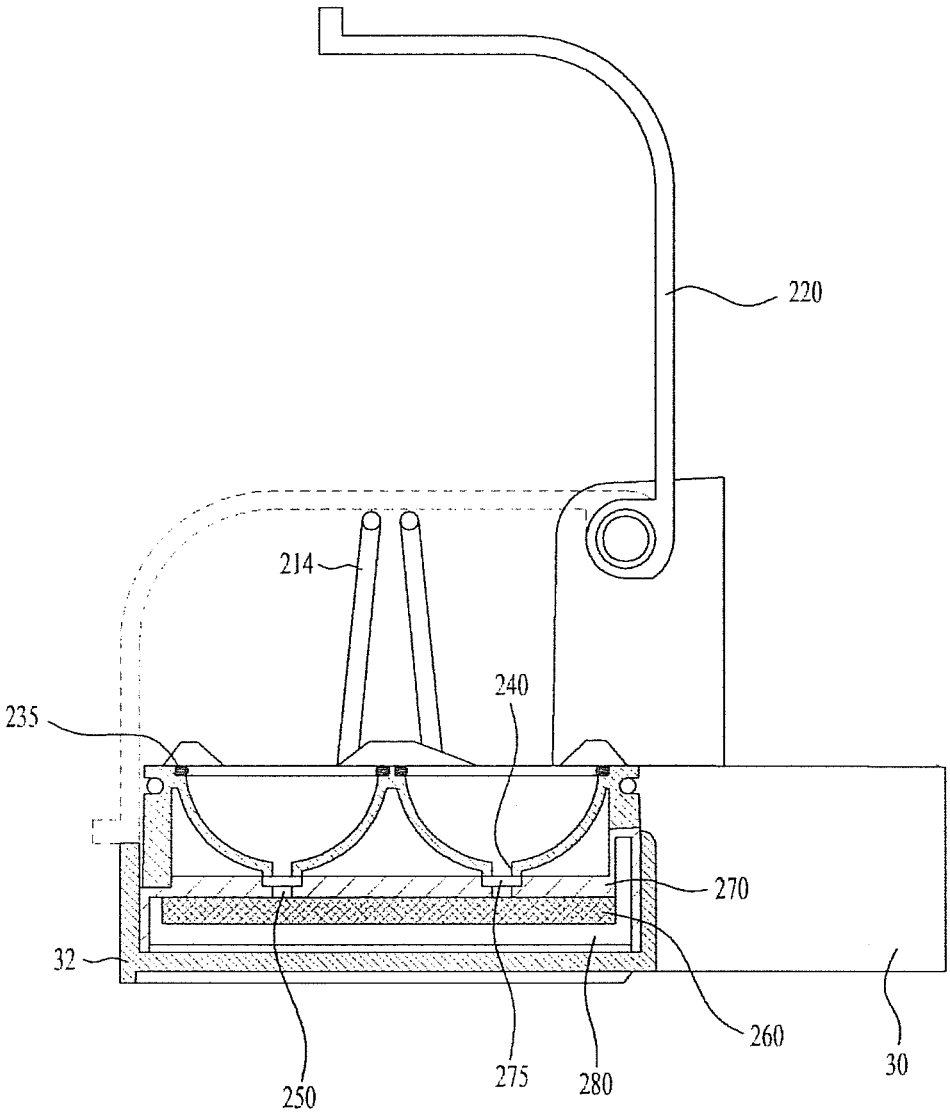
FIG. 9 is a cross-sectional view of the egg tray shown in FIG. 8 mounted on a door shelf.

The second egg storage device 200 may be installed on the inner surface of the refrigerating chamber door 30, as shown in FIGS. 1 and 7.

Although the exemplary refrigerator may include both the first egg storage devices 100 and the second egg storage device 200, the refrigerator may include only one first egg storage device 100 and the second egg storage device 200.

As shown in FIG. 7, an egg tray 210 of the second egg storage device 200 may be detachably mounted in the door shelf 32 at the upper portion of the inner surface of the refrigerating chamber door 30. A light sensing device of the second egg storage device 200 may be mounted on and fixed to the bottom of the door shelf 32 in the same manner as the light sensing device of the first egg storage device 100, and the egg tray 210 may be received on the light sensing device.

The egg tray 210 may include handles 214 which may be gripped by a user. The handles 214 may have a shape passing longitudinally over the center of the egg tray 210 so that a user may move the egg tray while grasping the handles 214 with one hand. In more detail, the handles 214 may be formed by, for example wires having a shape surrounding the side portion of the egg tray 210 and then passing over the egg tray 210 in the longitudinal direction. The handles 214 may be configured such that a user may conveniently grasp the centers of the upper portions of the handles 214 with one hand.

The egg tray 210 may include a plurality of storage slots 230 formed in a somewhat semi-spherical shape so as to receive an egg, and a plurality of through holes 240 respectively formed at the centers of the storage slots 230. The arrangement and shape of the plurality of storage slots 230 of the egg tray 210 may differ from the arrangement and shape of the plurality of storage slots 130 of the egg tray 110 shown in FIG. 3. For example, the plurality of storage slots 230 having a predetermined size may be properly arranged so that a restricted space may be effectively used according to the size of the egg tray 210.

Rubber rings 235 may be provided at the upper ends of the respective storage slots 230 of the egg tray 210 and thus stably support received eggs and prevent generation of a sensing error of a light sensing device.

An opening of the upper surface of the door shelf 32 may be opened and closed by a rotatable cover 220. A rotary shaft of the cover 220 may be mounted above the door shelf 32. When the cover 220 is closed, the cover 220 may contact the edge of the upper end of the door shelf 32 and thus be supported by the edge of the upper end of the door shelf 32. Therefore, the cover 220 and the door shelf 32 form a space in which the egg tray 210 is installed. The cover 220 may be formed of a transparent material so that eggs received on the egg tray 210 may be visible without opening the cover 220.

In the same manner as the light sensing device shown in FIGS. 4 and 5, the light sensing device in accordance with this embodiment may include a circuit board 260 including a plurality of illumination sensors 250 formed at positions corresponding to the plurality of through holes 240, a cover plate 270 covering the upper surface of the circuit board 260 and including a plurality of accommodation holes 272 into which the plurality of illumination sensors 250 and a plurality of transparent lids 275 are inserted, and a base plate 280 attached to the lower surface of the circuit board 260.

Figure 10:
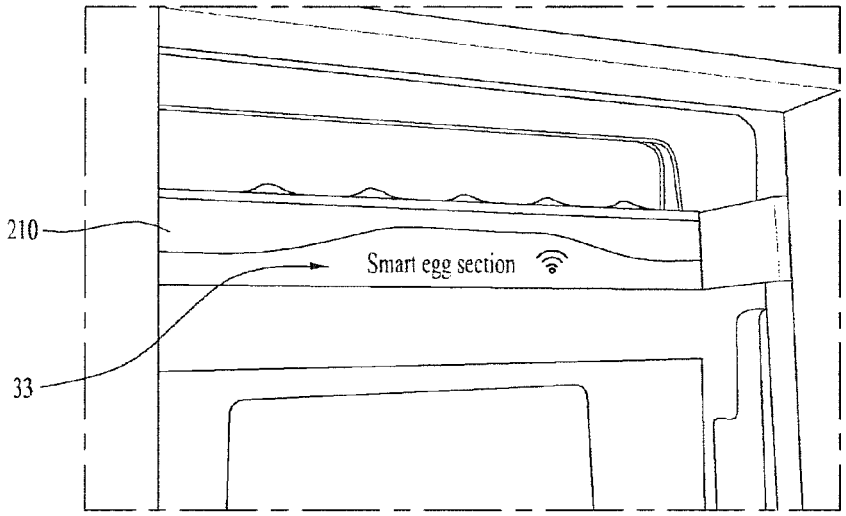
FIG. 10 is a partial perspective view of the egg tray shown in FIG. 8 mounted on a door shelf of a main door, with a sub-door open.

FIG. 10 is a partial perspective view of a state in which the egg tray 210 is mounted on the inner surface of the main door 30, with the sub-door 40 open.

A display part 33 indicating the second egg storage device 200 may be provided on the front surface of the door shelf 32 in which the egg tray 210 is received.

The display part 33 may be provided on a surface of the door shelf 32 opposite the sub-door 40 rather than the egg tray 210. The display part 33 may display, for example, characters such as "smart egg section", together with marks. The display part 33 may be an LED lighting part and may be configured so as to be switched on when the sub-door 40 is opened.

Although the refrigerator including the egg storage devices has been described in detail, the disclosure may be applied to a low temperature storage apparatus, such as an automatic vending machine, including storage trays receiving stored articles, in particular, articles having a predetermined shape, such as cans.

Figure 11:
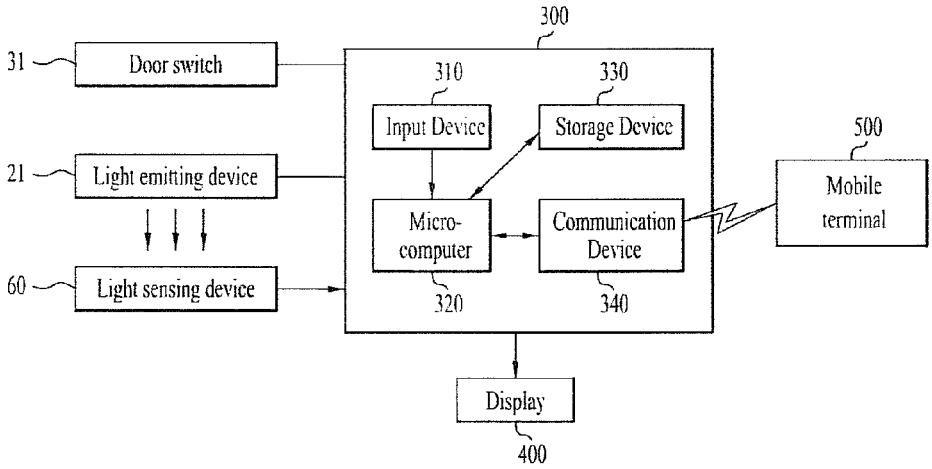
FIG. 11 is a block diagram of an apparatus in accordance with one embodiment as broadly described herein.

FIG. 11 is a block diagram of a controller and components related to the controller in a low temperature storage apparatus, in accordance with an embodiment as broadly described herein.

In the same manner as the refrigerator, the low temperature storage apparatus may include a main body having a storage chamber therein, a door opening and closing the storage chamber, a tray provided in the storage chamber and including a plurality of storage slots receiving storage articles, a lighting emitting device 21 installed within the storage chamber, a light sensing device 60 including a plurality of light receiving sensors respectively disposed under the plurality of storage slots and sensing light incident upon the storage slots from the light emitting device 21, and a controller 300 controlling the light emitting device 21, processing and storing sensing signals from the light sensing device 60, and providing state information regarding a number and positions of the stored articles to a user.

The low temperature storage apparatus may be, for example, a vending machine for canned or bottled beverages or a general low temperature storage apparatus including a receipt tray receiving stored articles of a predetermined shape and a light sensing device. The receipt tray may include a plurality of storage slots formed in, for example, a concave shape so as to receive stored articles and a plurality of through holes formed through portions, for example, central portions, of the plurality of storage slots. The shape of the storage slots may be formed so as to be fitted to the shape of the stored articles. If the stored articles are cylindrical cans, the storage slots may have the shape of a semi-circular column.

The light sensing device 60 may include a plurality of illumination sensors mounted below the storage slots of the receipt tray and disposed under the respective through holes.

The low temperature storage apparatus may include a door switch 31 and the light emitting device 21 and may thus sense stored articles without connection with opening and closing of the door or without opening the door.

The controller 300 may include an input device 310 receiving information related to stored articles input by a user, a micro-computer 320 calculating or judging information received by the input device 310 and the light sensing device 60, a storage device 330 storing the input and calculated or judged state information of stored articles, and a communication device 340 receiving a user command signal and transmitting the state information of stored articles through communication with a mobile terminal 500.

The input device 310 may allow a user to directly input information related to stored articles, such as purchase dates, receipt dates, and/or expiration dates of the stored articles. The input device 310 may include, for example, a plurality of buttons on the front surface of the low temperature storage apparatus, or may be a touchscreen type device. If a display 400 is provided with the apparatus and the display 400 is a touchscreen, the user may input information related to stored articles through the display 400.

The micro-computer 320 not only controls overall operation of the low temperature storage apparatus but also calculates or judges data received from the input device 310 and the light sensing device 60.

The storage device 330 stores the information related to the stored articles, input received by the input device 310 and calculated or judged by the micro-computer 320.

The micro-computer 320 classifies data which the storage device 330 will store, or reads data stored in the storage device 330 and then provides the data to the user.

The communication device 340 may communicate with the user mobile terminal 500, and may receive a user command signal or transmit information related to the stored articles through communication with the mobile terminal 500.

The controller 300 may provide information regarding, for example, the number and positions of the stored articles, as well as information related to the stored articles.

Such state information may be displayed by the display 400 provided, for example, on the front surface of the main body of the low temperature storage apparatus or the mobile terminal 500.

In general, the display 400 may be connected to the controller 300 by wire, or may communicate with the controller 300 wirelessly through the communication device 340.

A control method of a low temperature storage apparatus based on operation of the door switch 31, in accordance with one embodiment, will be described with reference to FIG. 12.

The controller 300 may switch the light emitting device 21 on when the door is opened, receive and store sensing signal data from the light sensing device 60 when the door is closed, while the light emitting device 21 remains on for a predetermined time after the door has closed, and then switch the light emitting device 21 off after the predetermined time from closing of the door has elapsed.

First, when the door switch 31 senses opening of the door (S10), the light emitting device 21 is switched on and illuminates the inside of the storage chamber (S20).

When the opened door is closed and the door switch 31 senses closing of the door (S30), the controller 300 receives sensing signal data from the light sensing device 60 and stores the sensing signal data in the storage device 330 (S40).

At this point, even if the door is closed, the light emitting device 21 is not immediately switched off and remains on for a predetermined amount of time so that the light sensing device 60 may collect information. In particular, the light receiving sensors of the light sensing device 60 may sense light emitted by the light emitting device 21 after the door has closed.

Thereafter, the controller 300 judges whether or not a predetermined time from closing of the door has elapsed (S50), and switches the light emitting device 21 off upon judging that the predetermined time has elapsed (S60).

The predetermined time from closing of the door may be, for example, within 5 seconds.

In order to reduce unnecessary power consumption, the controller 300 may switch the light emitting device 21 off just after the controller 300 receives the sensing signal data from the light sensing device 60.

Therefore, the predetermined time may be set to be a minimum amount of time, taking into consideration a sensing time of the sensors and a data transmission time.

If whether or not the controller 300 receives the sensing signals may be sensed, the controller 300 may control the light emitting device 21 so that the light emitting device 21 is switched off just after the controller 300 receives the sensing signals.

Figure 13:
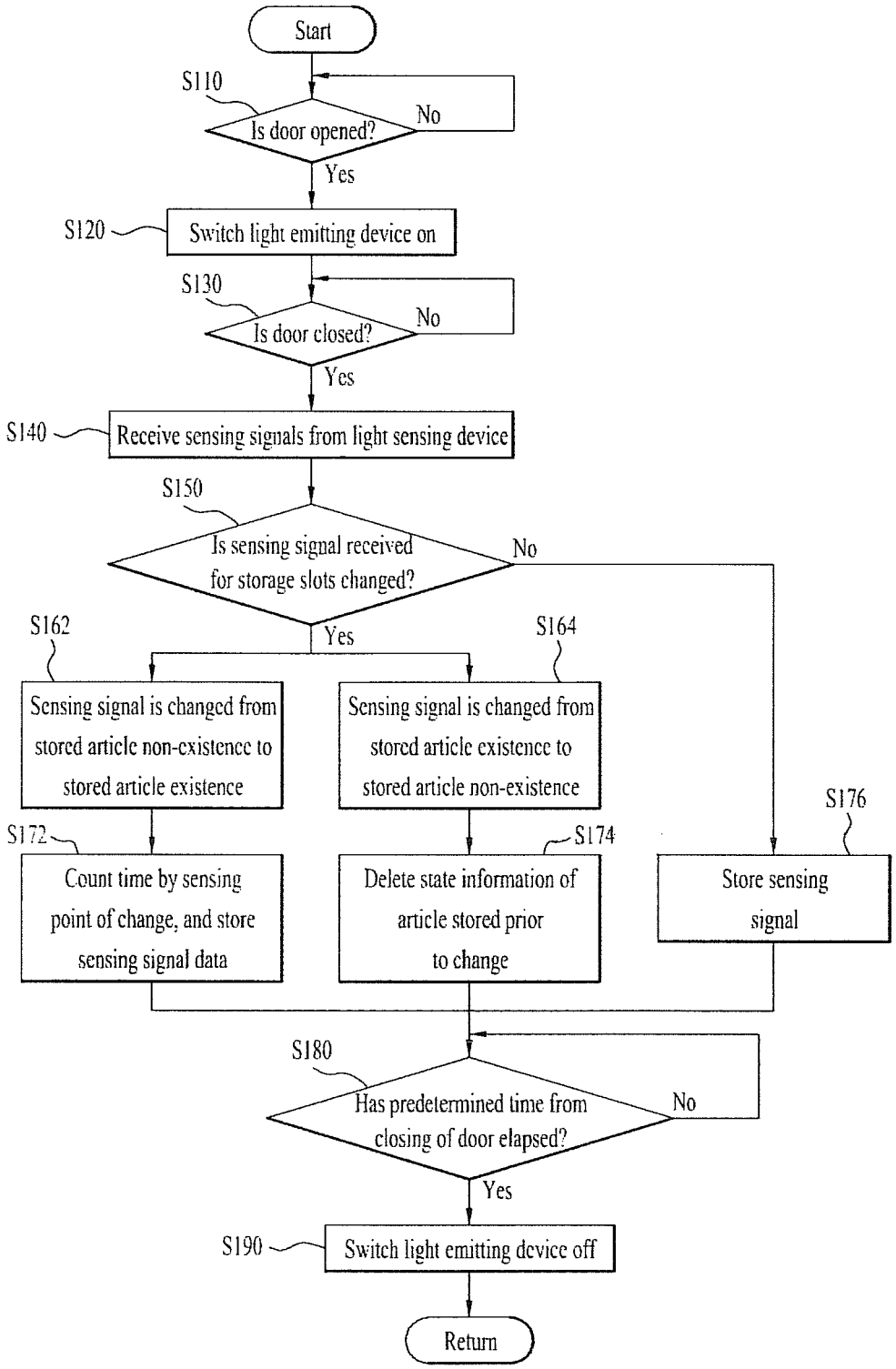
FIG. 13 is a flowchart of a control flow of the controller in accordance with another embodiment as broadly described herein.

A control method of a low temperature storage apparatus based on operation of the door switch 31, in accordance with another embodiment will be described with reference to FIG. 13.

The low temperature storage apparatus in accordance with this embodiment may include a main body having a storage chamber installed therein, a door opening and closing the storage chamber, a receipt tray provided in the storage chamber and including a plurality of storage slots receiving storage articles, a lighting emitting device 21 installed within the storage chamber, a light sensing device 60 including a plurality of light receiving sensors respectively disposed under the plurality of storage slots and sensing light incident upon the storage slots from the light emitting device 21, and a controller 300 controlling the light emitting device 21, processing and storing sensing signals from the light sensing device 60, and externally providing information related to receipt positions and storage periods of the stored articles.

Figure 12:
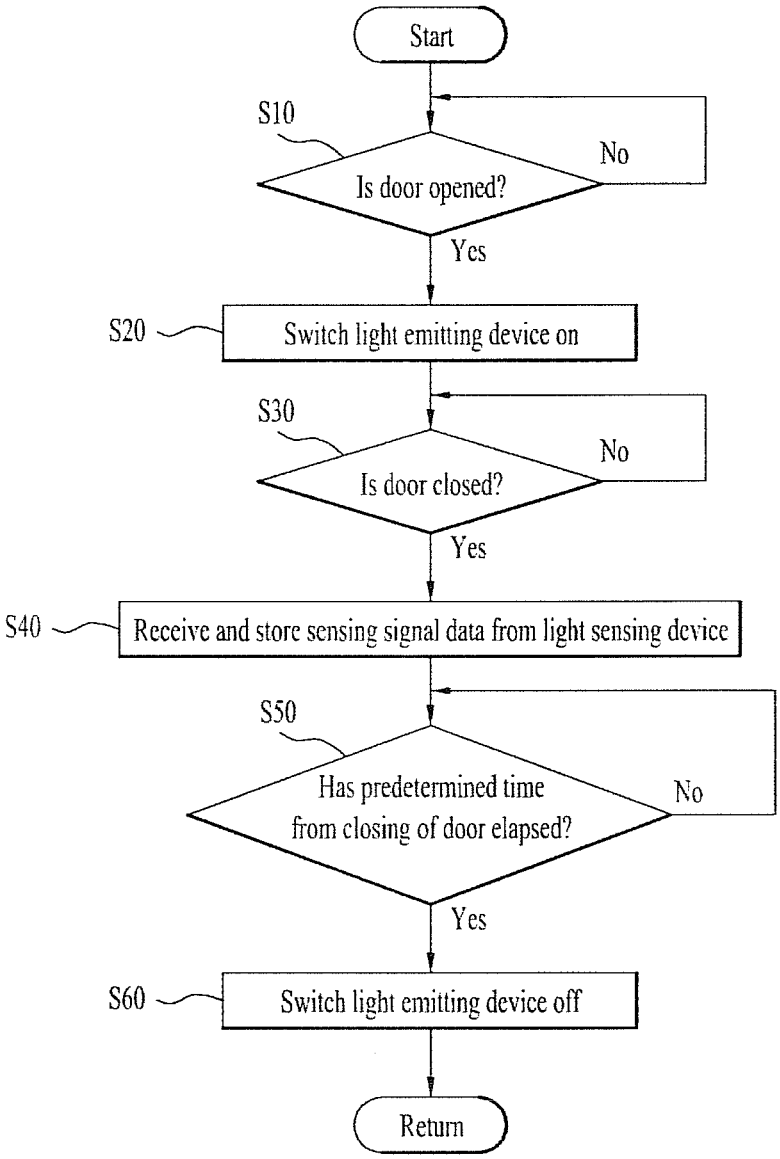
FIG. 12 is a flowchart of a control flow of a controller in accordance with one embodiment as broadly described herein.

As compared to the low temperature storage apparatus in accordance with the embodiment shown in FIG. 12, the low temperature storage apparatus in accordance with this embodiment differs in that the controller 300 provides state information regarding the receipt positions and storage periods of stored articles.

The controller 300 may switch the light emitting device 21 on when the door is opened, receive sensing signal data from the light sensing device 60 when the door is closed, count time from a point of change of the sensing signal and store the sensing signal data if the sensing signal received for each storage slot is changed from stored article non-existence to stored article existence by sensing whether or not the sensing signal received by each storage slot is changed, and switch the light emitting device 21 off when a predetermined time from closing of the door has elapsed.

First, when the door switch 31 senses opening of the door (S110), the light emitting device 21 is switched on and illuminates the inside of the storage chamber (S120).

When a user closes the opened door and then the door switch 31 senses closing of the door (S130), the controller 300 receives sensing signal data from the light sensing device 60 (Operation S140).

Thereafter, it is determined whether or not the sensing signal data received for each individual storage slot is changed (S150).

If a sensing signal for one or more of the storage slots is changed, for example, from stored article non-existence to stored article existence, i.e., if a light sensing signal did not previously exist and now exists (S162), this indicates a storage item has been replenished, and time from such a point of change is counted by sensing the point of change, and the sensing signal data is stored (S172).

Since change of the sensing signal from stored article non-existence to store article existence indicates a user has placed a stored article into a specific storage slot, the storage time of the stored article may be calculated by counting time from this point.

Since the storage periods of stored articles accommodated in the respective storage slots may be different, whether or not sensing signals received by the storage slots are changed may be respectively determined.

If a sensing signal is changed from stored article existence to stored article non-existence (S164), the state information corresponding to the article stored prior to change is deleted (Operation S174).

Since change of the sensing signal from existence to non-existence indicates a stored article has been removed from a specific storage slot, the state information of the stored article is no longer needed.

If a sensing signal is not changed, the received sensing signal is stored (S176).

After the sensing signals of stored articles in the respective storage slots have each been updated in such a manner, the controller 300 determines whether or not a predetermined time from closing of the door has elapsed (S180), and switches the light emitting device 21 off upon determining that the predetermined time has elapsed (S190).

The low temperature storage apparatus in accordance with this embodiment may provide storage periods of stored articles as well as the positions and number of stored articles based on a determination of existence and non-existence of the stored articles accommodated in the respective storage slots.

Although a user does not record the storage periods of stored articles when the stored articles are accommodated in the low temperature storage apparatus, the controller 300 may automatically calculate the storage periods of the stored articles and display the calculated storage periods of the stored articles.

FIGS. 14 to 17 illustrate exemplary images displayed a display or a mobile terminal.

Figure 14:
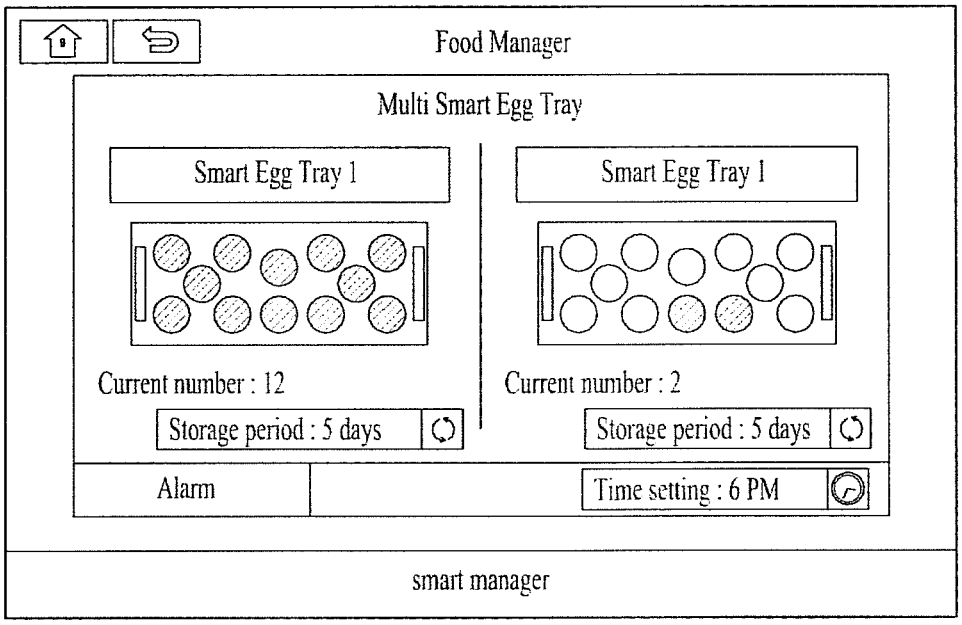
FIG. 14 illustrates an exemplary display image on a refrigerator display.

First, FIG. 14 provides images of egg trays received in a refrigerator in which two egg trays are provided in the above-described first egg storage devices 100.

Here, whether or not eggs exist in storage slots of the respective egg trays is displayed according to positions, and the current numbers and storage periods of the eggs of the respective egg trays are displayed thereunder.

Further, an alarm may be provided at the left side and a time setting may be provided at the right side thereunder. The alarm may be activated if the current number of eggs is at or below a predetermined number and, when a user touches the alarm, a pop-up window displaying warning content may appear. Time displayed in the time setting may be time when the user checks the current number of eggs every day or time when the alarm provides warning to the user.

In the exemplary image shown in FIG. 14, each of the left and right egg trays may accommodate 12 eggs, 12 eggs are accommodated in the left egg tray, and 2 eggs are accommodated in the right egg tray. The storage periods of the eggs accommodated in the left and right egg trays are 5 days. If the storage periods of the eggs accommodated in the left and right egg trays are not equal, when an egg in each storage slot is touched, the storage period of such an egg may be displayed.

Figure 15A:
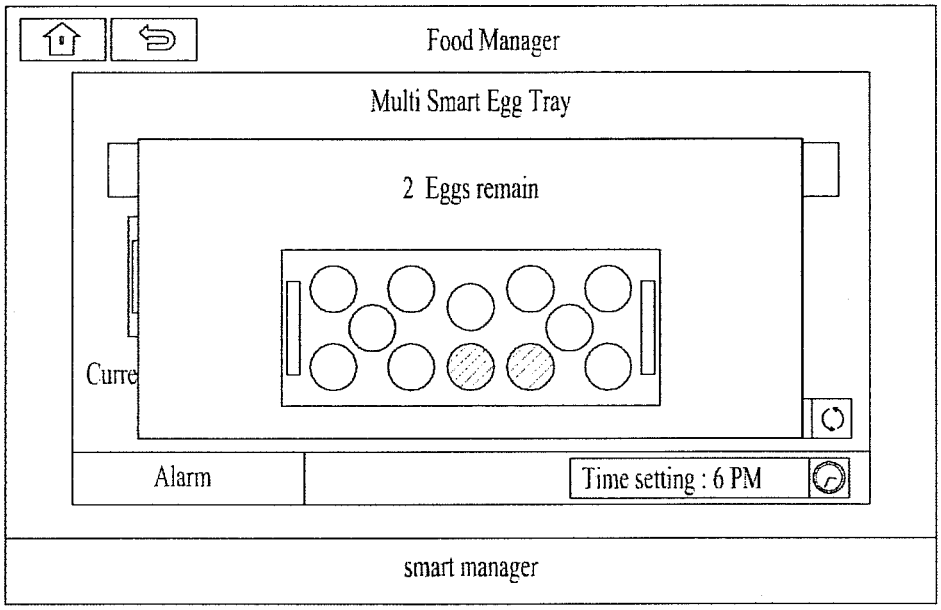
FIGS. 15A and 15B are front views of an online purchase request via a warning pop-up window provided in the display shown in FIG. 14.
Figure 15B:
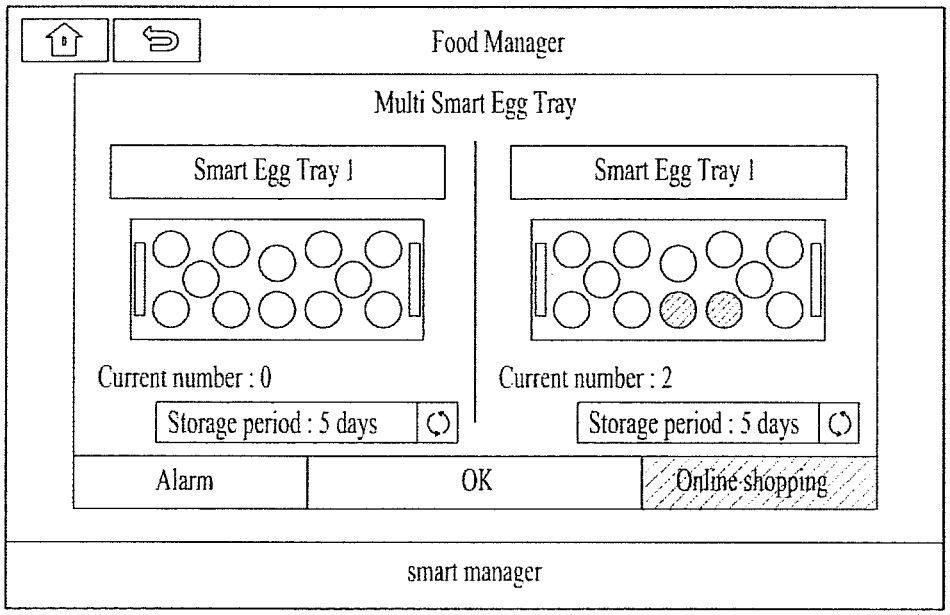

FIGS. 15A and 15B illustrate exemplary images displaying a warning and an online shopping option if 2 eggs remain.

First, as shown in FIG. 15B, if no eggs remains in the left egg tray and 2 eggs remain in the right egg tray, the alarm may be activated and provide warning to a user. When the user touches the alarm, the image of the egg tray together with a warning message "2 eggs remain" may be displayed through a pop-up window, as shown in FIG. 15A. The user may confirm receipt of the warning message by touching the pop-up window and then purchase eggs on-line by pressing an online shopping item arranged at the lower portion of the right side.

Figure 16:
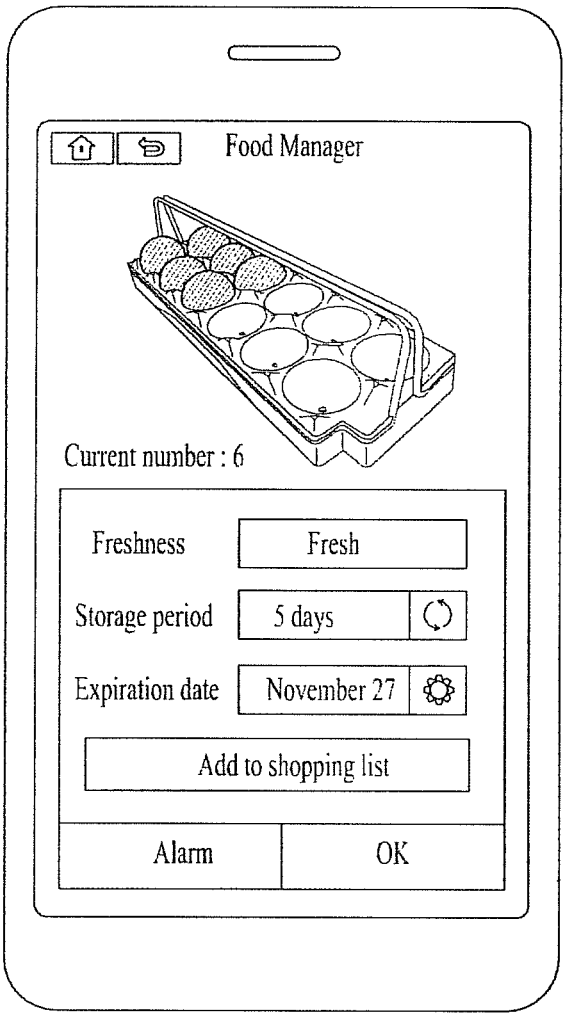
FIG. 16 illustrates an exemplary display image on a mobile terminal.
Figure 17:
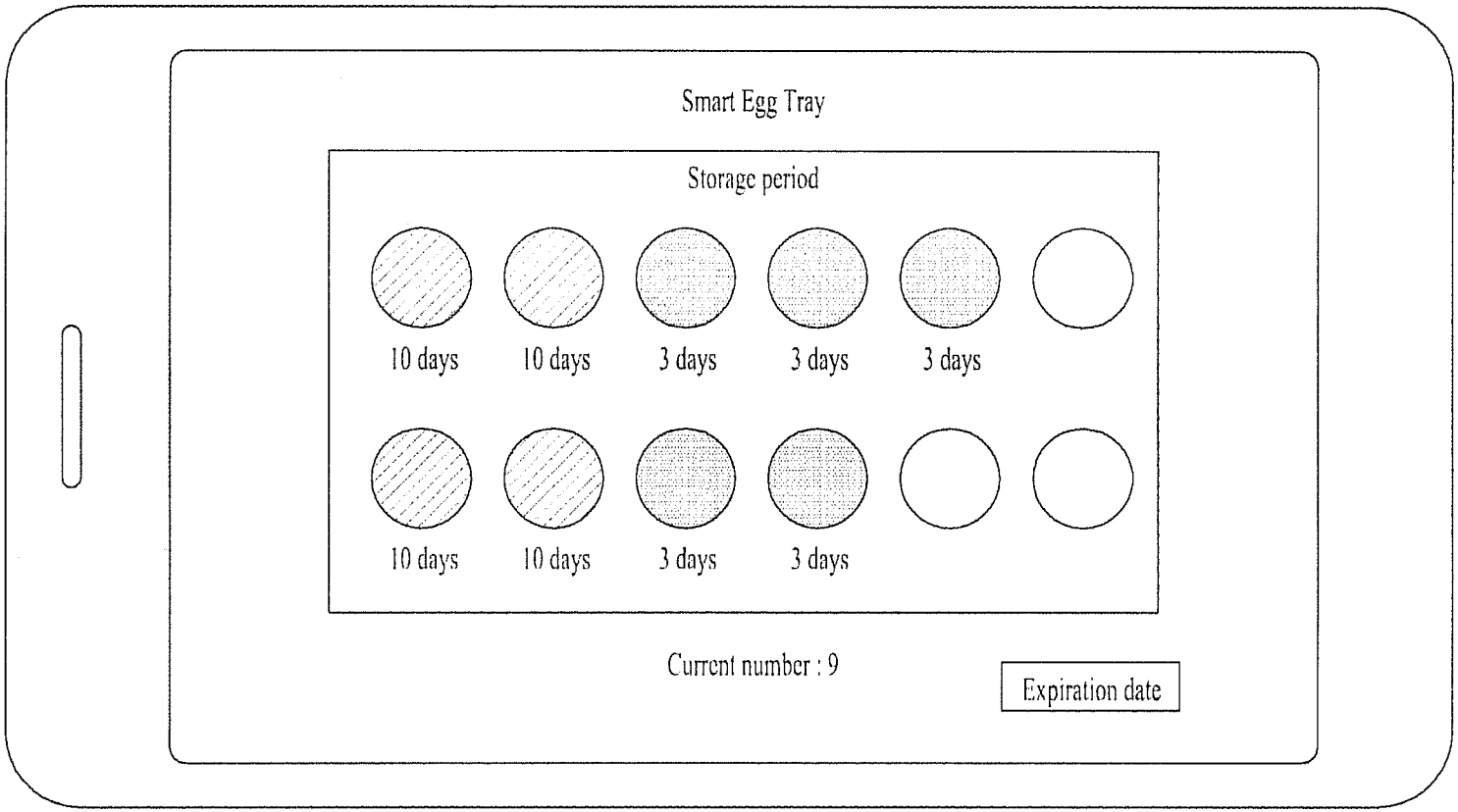
FIG. 17 illustrates another exemplary display image on the mobile terminal.

FIGS. 16 and 17 are exemplary images displayed on a mobile terminal, such as a smart phone, illustrating the state of eggs accommodated in a second egg storage device 200 provided on the inner surface of the door.

First, FIG. 16 illustrates a perspective view of the egg tray of the second egg storage device 200, displaying existence of eggs in 6 of the 12 available storage slots through both an image and text. A freshness level, storage period, and expiration date of the eggs are respectively stated under the image. The storage period may be automatically counted, as described above, or input through the input device when the eggs are placed into the egg tray. The controller 300 may display the expiration date only if the expiration date is input through the input device. The freshness may be automatically calculated from the storage period, the input expiration date, and the current date, and thus displayed.

If the expiration date is not input, the controller may approximate the freshness from the storage period, taking into consideration of the general expiration period of eggs. For example, the general circulation period of eggs may be about 30 days and, on the assumption that a point of purchasing eggs is about 1 week from a production date, if the storage period of eggs is within about 3 weeks, it may be determined that the expiration date of the eggs has not elapsed. That is, if the storage period of an egg is 14 days, the available period of the egg may be calculated as the next 7 days. Therefore, the fact that the next 7 days remain as the available period may be displayed to the user and the freshness item may display "fresh".

FIG. 17 illustrates an exemplary image displayed on a smart phone in which, if the storage periods of eggs accommodated in respective storage slots are different, the eggs in the respective storage slots are expressed with different colors.

That is, if the storage periods of eggs accommodated in the egg tray are different, the image of FIG. 16 does not display the freshness, storage periods, and expiration dates of the eggs, but rather, may display only the positions and number of the eggs. When the user touches the egg tray, the image of FIG. 17 may appear and the storage periods of the respective eggs in the storage slots may be displayed.

For example, 4 eggs having the storage period of 10 days and 5 eggs having the storage period of 3 days, i.e., a total of 9 eggs, are accommodated in the egg tray in the example shown in FIG. 17.

The current number of eggs may be stated under a rectangle representing the egg tray, and the expiration date may be stated at the right of the current number.

When the user presses the expiration date item, the storage periods of the respective eggs may be changed. Such a change may be carried out if the user inputs the expiration dates of the respective eggs in advance.

In accordance with this embodiment, state information of stored articles, i.e., eggs or cans, such as a number of remaining storage articles and the storage periods of the stored articles, may be checked remote from a place where a low temperature storage apparatus is installed and thus, the stored articles may be conveniently received and managed.

As apparent from the above description, in a low temperature storage apparatus in accordance with one embodiment as broadly described herein, a user may confirm a number of stored articles, such as eggs or cans, without opening a door.

Further, since a light sensing device including a plurality of light receiving sensors is provided under a receipt tray of the stored articles, the light sensing device may have a simple structure, excellent reliability in sensing presence and absence of stored articles, and high durability.

Further, since the light sensing device and the receipt tray may be mounted so as to be separable from each other, the user may easily separate the receipt tray from the light sensing device and thus conveniently use the receipt tray.

Further, the low temperature storage apparatus may automatically count the storage periods of the stored articles, thus maintaining a fresh storage state of the stored articles.

Moreover, the low temperature storage apparatus may display state information of the stored articles, such as the number, positions, storage periods, or expiration dates of the stored articles, through communication with a user mobile terminal, such as a smart phone, so that the user may confirm the storage state of the stored articles anytime and anywhere, thus providing for convenient management and use.

A low temperature storage apparatus is provided in which a user may obtain a number of stored articles accommodated in the low temperature storage apparatus without opening a door.

A low temperature storage apparatus, as embodied and broadly described herein, may include a main body provided with a storage chamber installed therein, a door opening and closing the storage chamber, a receipt tray provided in a storage space within the main body and including a plurality of storage slots receiving a plurality of stored articles, a light emitting device installed in the storage space, a light sensing device including a plurality of light receiving sensors disposed under the plurality of storage slots and sensing light incident upon the plurality of storage slots from the light emitting device, and a controller controlling the light emitting device, receiving sensing signals of the light sensing device, and providing state information of the plurality of stored articles to a user, wherein the controller switches the light emitting device on when the door is opened, senses whether or not the sensing signal received by each storage slot is changed when the door is closed, and counts time from a point of change of the sensing signal if the sensing signal is changed from stored article non-existence to stored article existence, and switches the light emitting device off when a predetermined time from closing of the door has elapsed.

The receipt tray may include the plurality of storage slots formed in a concave shape so as to receive the plurality of stored articles, a plurality of through holes respectively formed on the bottoms of the plurality of storage slots, and rubber rings mounted at the upper ends of the plurality of storage slots and elastically supporting received eggs.

The light sensing device may further include a circuit board including a plurality of illumination sensors disposed at positions corresponding to the plurality of through holes, a cover plate covering the upper surface of the circuit board and including a plurality of accommodation holes, into which the plurality of illumination sensors is inserted, and a base plate attached to the lower surface of the circuit board.

The plurality of accommodation holes of the cover plate may be respectively closed by a plurality of transparent lids.

The receipt tray may be detachably mounted in a receipt hole formed in a concave shape on the bottom of the storage chamber and further include a handle gripped by a user.

The light sensing device may be buried under the bottom of the receipt hole, and the receipt tray may be detachably mounted on the light sensing device.

The light emitting device may be provided in the storage chamber.

The low temperature storage apparatus may further include a transparent cover covering an opening of the upper surface of the receipt hole and including a handle.

The receipt tray may include a lighting part provided at one side thereof and tray terminals connected to the lighting part and protruding from the lower portion thereof, and fixing terminals connected to the tray terminals when the receipt tray is received in the receipt hole may be provided at positions of the receipt hole corresponding to the tray terminals.

The light sensing device may be operated when the tray terminals are connected to the fixing terminals.

The receipt tray may be detachably mounted in a door shelf mounted on the inner surface of the door.

The light emitting device may be provided at the upper portion of the inner surface of the door.

The light sensing device may be buried under the bottom of the door shelf, and the receipt tray may be detachably mounted on the light sensing device.

An opening of the upper surface of the door shelf may be opened and closed by a transparent cover rotatably mounted.

The state information of the plurality of stored articles may include at least one of the number of the plurality of stored articles, and the positions, storage periods and expiration dates of the plurality of stored articles.

The low temperature storage apparatus may further include a door switch sensing whether or not the door is opened or closed.

The controller, if the sensing signal is changed from stored article existence to store article non-existence, may delete the state information of the stored article stored prior to change.

The controller may calculate the storage period of each of the plurality of stored articles received in the plurality of storage slots from the counted time, and provide both the calculated storage period and existence and non-existence of each of the plurality of stored articles in the plurality of storage slots.

The controller may display the state information of the plurality of stored articles through a display provided on the main body of a user mobile terminal.

The controller may include an input unit receiving the state information of the plurality of stored articles, input by a user, a micro-computer calculating or judging information input from the input unit and the light sensing device, a storage unit storing the input and calculated or judged state information of the plurality of stored articles, and a communication unit receiving a user command signal and transmitting the state information of the plurality of stored articles through communication with the mobile terminal.

The controller may receive the expiration date of each of the plurality of stored articles received in the plurality of storage slots through the input unit, and give warning to the user through the display or the mobile terminal if the expiration date has passed or days of a predetermined number or below remain to reach the expiration date.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A low temperature storage apparatus, comprising:

a main body having a storage chamber;

a door coupled to the main body that opens and closes the storage chamber;

a tray provided in a storage space within the main body and including a plurality of storage slots having a concave shape and configured to receive a plurality of articles to be stored;

a light emitting device installed on an inner wall of the storage space;

a light sensing device including:

a plurality of illumination sensors respectively arranged under the plurality of storage slots and configured to sense light incident upon the plurality of storage slots from the light emitting device, wherein a plurality through holes is respectively formed in bottom portions of the plurality of storage slots and the plurality of illumination sensors is arranged on a circuit board, under the plurality of through holes respectively; and a base plate attached to a lower surface of the circuit board; and a controller that controls the light emitting device, receives sensing signals from the light sensing device, and provides state information related to the plurality of stored articles, wherein the controller is configured to:

switch the light emitting device on when the door is opened;

after the door is closed, sense whether or not a sensing signal received for each of the plurality of storage slots is changed from a previous sensing signal, and count time from a point at which the sensing signal is determined to have changed if the sensing signal is changed from stored article non-existence to stored article existence; and switch the light emitting device off when a predetermined time from a point at which the door is closed has elapsed.

2. The apparatus of claim 1, wherein the tray further includes:

a plurality of rubber rings respectively provided at upper ends of the plurality of storage slots, wherein the plurality of rubber rings elastically supports the plurality of stored articles respectively received therein.

3. The apparatus of claim 1 wherein the light sensing device further includes:

a cover plate that covers an upper surface of the circuit board and including a plurality of accommodation holes at which the plurality of illumination sensors is respectively received.

4. The apparatus of claim 3, further including a plurality of transparent lids respectively received in the plurality of accommodation holes of the cover plate so as to enclose the plurality of illumination sensors in the plurality of accommodation holes.

5. The apparatus of claim 1, wherein the tray is detachably coupled in a concave recess formed in a bottom surface of the storage chamber and further includes at least one handle for insertion and removal of the tray into and out of the recess.

6. The apparatus of claim 5, wherein the light sensing device is provided below a bottom surface of the recess on which the tray is received and the tray is detachably coupled to the light sensing device.

7. The apparatus of claim 5, further including a transparent cover that covers an open upper surface of the recess, the cover including a handle.

8. The apparatus of claim 5, wherein the tray includes:

a lighting part provided at one side thereof; and tray terminals connected to the lighting part, wherein the tray terminals protrude from a lower portion thereof, and wherein fixing terminals are provided in the recess at positions corresponding to the tray terminals, such that the tray terminals are connected to the fixing terminals when the try is received in the recess, and the light sensing device is configured to operate when the tray terminals are connected to the fixing terminals.

9. The apparatus of claim 1, wherein the tray is detachably coupled to a shelf mounted on an inner surface of the door, and the light emitting device is provided at an upper portion of the inner surface of the door.

10. The apparatus of claim 9, wherein the light sensing device is provided beneath a surface of the door shelf on which the tray is received, and the tray is detachably coupled to the light sensing device.

11. The apparatus of claim 9, further including a transparent cover rotatably coupled with respect to the shelf so as to open and close an open upper face of the shelf.

12. The apparatus of claim 1, wherein the state related to the plurality of stored articles includes at least one of a number of the plurality of stored articles, positions of the plurality of stored articles, storage periods of the plurality of stored articles, or expiration dates of the plurality of stored articles.

13. The apparatus of claim 1, further including as door switch that senses whether the door is opened or closed relative to the main body.

14. The apparatus of claim 1, wherein, if the sensing signal is changed from stored article existence to stored article non-existence, the controller is configured to delete the state information related to the stored article.

15. The apparatus of claim 1, wherein the controller is configured to calculate a storage period for each of the plurality of stored articles received in the plurality of storage slots based on the counted time, and to provide both the calculated storage period and an indication of existence and non-existence of one of the plurality of stored articles in each of the plurality of storage slots.

16. The apparatus of claim 1, wherein the controller is configured to display the state information related to the plurality of stored articles on a display provided on the main body or on a mobile terminal.

17. The apparatus of claim 16, wherein the controller includes;

an input that receives externally input state information related to the plurality of stored articles;

a micro-computer that processes information received from the input and the light sensing device;

a storage device that stores the information received from the input and the light sensing device and processed by the micro-computer related to the state information of the plurality of stored articles; and a communication device that transmits the state information related to the plurality of stored articles through communication with the mobile terminal in response to a user command.

18. The apparatus of claim 17, wherein the controller receives an expiration date for each of the plurality of stored articles received in the plurality of storage slots through the input, and generates an external warning through the display or the mobile terminal if the expiration date has passed or if a number of days remaining to the expiration date are less than or equal to a predetermined number of days.

19. A method of operating a low temperature storage apparatus, the storage apparatus including a main body haying a storage chamber formed therein and a door coupled to the main body to open and close the storage chamber, the method comprising:

receiving a door open signal indicating the door is in an open position relative to the main body;

switching on a light emitting device installed on an inner wall of the storage chamber in response to the door open signal;

receiving a door closed signal indicating the door is in a closed position relative to the main body, and maintaining operation of the light emitting device for a predetermined amount of time after receiving the door closed signal;

receiving a sensing signal from a light sensing device provided beneath a plurality of storage slots formed in a tray configured to receive a plurality of storage items therein, wherein the light sensing device includes a plurality of illumination sensors arranged under a plurality of through holes formed in bottom portions of the plurality of storage slots, and the sensing signal indicates whether or not a storage item is received in each of the plurality of storage slots based on whether light emitted by the light emitting device is blocked by a storage item received in the respective storage slot and not received by the light sensing device, or is unobstructed and received by the light sensing device; and terminating operation of the light emitting device after the light sensing device has transmitted the sensing signal and the predetermined time has elapsed.

20. The method of claim 19, wherein receiving a sensing signal includes:

receiving an individual sensing signal for each of the plurality of storage slots of the tray;

when the sensing signal indicates a state of the corresponding storage slot has changed from no storage item received therein to storage item received therein, operating a timer to initiate counting of storage time for the storage item; and when the sensing signal indicates the state of the corresponding storage slot has changed from storage item received therein to no storage item received therein, deleting previously stored state information associated with storage item previously stored in the corresponding storage slot.

* * * * *